US008907569B2

(12) United States Patent
Tran

(10) Patent No.: US 8,907,569 B2
(45) Date of Patent: Dec. 9, 2014

(54) LIGHTING DEVICE FOR AN AC POWER SUPPLY

(71) Applicant: Diehl Aerospace GmbH, Ueberlingen (DE)

(72) Inventor: Trong Tran, Erlangen (DE)

(73) Assignee: Diehl Aerospace GmbH, Ueberlingen (DE)

( * ) Notice: Subject to any disclaimer, the term of this patent is extended or adjusted under 35 U.S.C. 154(b) by 121 days.

(21) Appl. No.: 13/659,426

(22) Filed: Oct. 24, 2012

(65) Prior Publication Data

US 2013/0106291 A1 May 2, 2013

(30) Foreign Application Priority Data

| | | |
|---|---|---|
| Oct. 27, 2011 | (DE) | 10 2011 117 047 |
| Nov. 24, 2011 | (DE) | 10 2011 119 301 |
| Dec. 2, 2011 | (DE) | 10 2011 120 062 |
| Dec. 3, 2011 | (DE) | 10 2011 120 299 |
| Jan. 14, 2012 | (DE) | 10 2012 000 605 |

(51) Int. Cl.
*H05B 37/00* (2006.01)
*H05B 37/03* (2006.01)

(52) U.S. Cl.
CPC ..... *H05B 37/036* (2013.01)
USPC ..... 315/122; 315/128; 315/193

(58) Field of Classification Search
CPC ..... H05B 37/036; H05B 37/04; H05B 41/46
USPC ..... 315/121–123, 127–128, 185 R, 193
See application file for complete search history.

(56) References Cited

U.S. PATENT DOCUMENTS

| | | | | |
|---|---|---|---|---|
| 7,800,316 | B2 * | 9/2010 | Haug | 315/299 |
| 7,986,107 | B2 * | 7/2011 | Weaver et al. | 315/291 |
| 8,188,679 | B2 * | 5/2012 | Hoogzaad | 315/294 |
| 2005/0077838 | A1 | 4/2005 | Blumel | |
| 2008/0224025 | A1 | 9/2008 | Lyons et al. | |
| 2009/0066267 | A1 | 3/2009 | Kraus et al. | |
| 2010/0123399 | A1 * | 5/2010 | Bollmann et al. | 315/122 |
| 2010/0134018 | A1 * | 6/2010 | Tziony et al. | 315/122 |
| 2010/0194274 | A1 * | 8/2010 | Hoogzaad | 315/51 |
| 2010/0308738 | A1 | 12/2010 | Shteynberg et al. | |
| 2010/0308739 | A1 * | 12/2010 | Shteynberg et al. | 315/193 |
| 2011/0006689 | A1 * | 1/2011 | Blanchard et al. | 315/121 |

(Continued)

FOREIGN PATENT DOCUMENTS

| | | | |
|---|---|---|---|
| DE | 10 2007 041 131 | A1 | 3/2009 |
| EP | 1 449 408 | B2 | 8/2007 |
| WO | WO 20101013172 | A1 | 2/2010 |

OTHER PUBLICATIONS

Beuth Klaus, Schmusch Wolfgang: Grundschaltungen—Elektronik 3, 16. Edition, Vogel Verlag Wurzburg 2007, p. 229, Figure 4.20, with English translation.

*Primary Examiner* — Jason M Crawford
(74) *Attorney, Agent, or Firm* — Scully, Scott, Murphy & Presser, P.C.

(57) ABSTRACT

A lighting device for an AC power supply comprising at least two lighting groups, wherein each lighting group has a group input and a group output and at least one LED, wherein the at least one LED is arranged between the group input and the group output, wherein the lighting groups are connected to one another in series.

26 Claims, 4 Drawing Sheets

(56) References Cited

U.S. PATENT DOCUMENTS

2011/0068702 A1* 3/2011 van de Ven et al. ..... 315/186
2011/0121741 A1* 5/2011 Yamamoto et al. ..... 315/193
2011/0198999 A1* 8/2011 Honma et al. ..... 315/77
2011/0273098 A1* 11/2011 Grajcar ..... 315/186
2011/0273102 A1 11/2011 van de Ven et al.

* cited by examiner

LIGHTING DEVICE FOR AN AC POWER SUPPLY

BACKGROUND OF THE INVENTION

The invention relates to a lighting device for an AC power supply, said lighting device comprising at least two lighting groups, wherein each lighting group has a group input and a group output and at least one LED, wherein the at least one LED is arranged between the group input and the group output and wherein the lighting groups are connected to one another in series.

DISCUSSION OF THE PRIOR ART

LEDs as light sources have significant advantages with regard to energy efficiency. For instance, unlike thermal light sources, such as incandescent bulbs etc. for example, a far greater proportion of the electrical energy is converted into visible light by LEDs, so that the efficiency is significantly greater than with thermal light sources.

The power supply for LEDs does cost somewhat more than thermal light sources, however. This is not least because individual LEDs only have a low light output, and therefore usually a large number of LEDs are combined to form a light source. It must be ensured when using a combination of LEDs that the LEDs are supplied with a limited individual voltage and a limited current so as not to damage the LEDs in operation.

In addition, when LEDs are connected in series, it is possible that if one LED in the series circuits burns out, all the LEDs in the series circuit are deactivated. This is why LEDs are normally connected in parallel, so that LEDs can fail and other LEDs remain operational.

Document EP1449408B2, which probably constitutes the closest prior art, describes a circuit arrangement for an LED array in which LEDs are connected in series in strings, with the strings being arranged in parallel with one another. When an LED fails in one string, although the entire string fails, all the other strings remain unaffected. Any number of LEDs can be connected together in series in one string.

SUMMARY OF THE INVENTION

The object of the invention is to propose a lighting device for an AC power supply that has a particularly simple design and reliable operation.

This object is achieved by a lighting device having the features of Claim 1. Preferred or advantageous embodiments of the invention are given in the subclaims, the following description and the enclosed figures.

A lighting device is presented according to the invention that is suitable and/or designed for an AC power supply. The lighting device can be used for lighting rooms, such as offices, factory halls etc. and particularly preferably for lighting mobile units, especially aircraft cabins. In particular, the lighting device is designed as an LED chain.

The lighting device comprises exactly or at least two lighting groups, each lighting group comprising a group input and a group output. At least one LED is connected between group input and group output, so that the group input and the group output are connected in an electrically conducting manner via the at least one LED. The at least one LED is arranged in the forward direction between group input and group output.

The at least two lighting groups are connected in series with one another and with the AC power supply, in particular with regard to a sub-period of the AC power supply. It can optionally be provided that the lighting groups are connected in series via a different signal path with regard to a different sub-period of the AC power supply, so that the supply for the lighting groups is taken by a first series circuit during a first sub-period of the AC power supply, and by another series circuit during the other sub-period of the AC power supply.

It is proposed as part of the invention that each of the at least two lighting groups comprises a bypass arrangement, said bypass arrangement comprising a switchable bypass. The bypass provides a signal path running parallel to all the LEDs in the lighting group and connects the group input to the group output.

The bypass arrangement is designed to activate the bypass when a voltage applied to the lighting group is less than a definable cutoff voltage, and to deactivate the bypass when an applied voltage is greater than the cutoff voltage.

If one considers, for example, a rise in the voltage value for a supply voltage that is generated on the basis of the AC power supply, then at a zero voltage the bypass is initially active. As the supply voltage rises while below the cutoff voltage, the current is diverted via the bypass past the at least one LED or all the LEDs. Only once the cutoff voltage is exceeded is the bypass deactivated, so that it is in the off-state and thus the current is directed via the at least one LED. If one now considers a series circuit of at least two lighting groups, then for a slow rise in the supply voltage, when the cutoff voltage is exceeded the at least one LED of the first lighting group is activated. The voltage value at the group output of the first lighting group is thereby reduced, however, so that the voltage applied to the next lighting group is again less than the cutoff voltage. Only once the supply voltage has risen so far that the voltage applied to the second lighting group is greater than the cutoff voltage is the bypass for the second lighting group deactivated and the at least one LED of the second lighting group supplied with current and thereby activated.

The lighting groups connected one after another in the series circuit are hence activated successively as the supply voltage rises. As soon as the supply voltage has reached its peak value and is decreasing again, the lighting groups are deactivated again in the reverse order by activation of the switchable bypasses.

The advantage of this simple circuit structure can be seen to be that only as many lighting groups are ever activated as the currently applied supply voltage permits. In addition, rectification of the AC voltage from the AC power supply is sufficient because there are no demands placed on the waveform of the supply voltage.

In a specific embodiment of the invention it is provided that in the lighting group a plurality of at least two LEDs are arranged in a series circuit.

In one possible implementation of the invention in circuitry, the bypass arrangement comprises a metal oxide semiconductor field effect transistor (MOSFET), wherein the bypass runs via the source and the drain of the MOSFET, wherein an auxiliary voltage that defines the cutoff voltage is applied to the control electrode (gate) of the MOSFET. It is also possible to use a bipolar transistor or a different switch instead of the MOSFET. The embodiment in circuitry ensures that the operation of the switching on and off of the bypass of the bypass arrangement is implemented safely, reliably and economically.

In a preferred development of the invention, a diode, in particular a rectifier diode, is connected in series in the bypass arrangement between the MOSFET, in particular the source, and the group output, the forward direction of said diode being parallel to the forward direction of the at least one LED in the lighting group. The diode ensures that with the bypass activated, the current flow can be diverted past the at least one LED, and with the bypass deactivated, interference caused by MOSFET voltages present at the group output is avoided.

In a possible development of the invention, the lighting device comprises at least one current-limiting arrangement, which is connected in series with the at least two lighting groups and/or with the AC power supply.

In a particularly simple embodiment of the invention, the current-limiting arrangement is in the form of an impedance, in particular a resistance. This current-limiting arrangement protects the LEDs from an overload.

In a preferred development of the invention, the current-limiting arrangement is implemented as a constant current source. Said constant current source has the further advantage that the LEDs in the lighting groups are always guaranteed a supply of current, and also that the lighting device has a dimmable design.

It is particularly preferable when the constant current source is designed to supply a current according to the supply voltage or another control signal for the purpose of synchronization with the AC power supply. This embodiment is based on the consideration that the current required depends on the number of activated lighting groups. With a low supply voltage, the number of activated lighting groups and hence the current demand is likewise low. For example, the current can be chosen to be proportional to the supply voltage. In particular in this embodiment, the lighting device behaves like a resistive load and does not pollute the mains power supply with interference signals.

In a preferred implementation of the invention, the lighting device comprises the AC power supply, said AC power supply being in the form of a voltage source, in particular a mains voltage source having a voltage that has an RMS value between 100V and 400V and, for example, of 115 Volts or 230 Volts. For a 230 Volts mains voltage, the number of LEDs to be used in the different lighting groups equals 80. The AC voltage source preferably has a frequency greater than 10 Hz, in particular greater than 30 Hz, e.g. of 50 Hz or 60 Hz or even between 50 Hz and 1000 Hz.

It is generally preferred that the lighting device comprises a rectifier for generating a rectified supply voltage. In a possible embodiment of the invention, the lighting device comprises a bridge rectifier for rectifying the voltage of the AC voltage source, wherein the supply voltage formed thereby for the lighting groups is in the form of a folded-over AC voltage. In this embodiment, therefore, during the first half-wave, the bypasses in the lighting groups are deactivated successively while at the same time the LEDs are successively supplied with current so that they start to emit light. After the peak value of the first half-wave, the supply voltage decreases again, the LEDs in the lighting groups are gradually de-energized in the reverse order. In the second half-wave, the process is repeated. Since the frequency of a typical mains voltage source is 60 Hertz, and twice the frequency is generated by the folding-over of the AC voltage, the lighting groups, in particular the LEDs in the lighting groups, are activated and deactivated at a frequency of e.g. 120 Hertz, which means, for example, that people can work without fatigue using the lighting device.

In another embodiment of the invention, the lighting device comprises a first half-wave rectifier and a second half-wave rectifier, which are arranged at the outputs of the AC power supply. For example, the half-wave rectifiers are in the form of diodes, in particular rectifier diodes. The first half-wave rectifier is connected to the group input of a first lighting group, and the second half-wave rectifier is connected to the group input of a second lighting group. The group output of the first lighting group is connected via a first decoupling diode, in particular a rectifier diode, to the group input of the second lighting group, and the group output of the second lighting group is connected via a second decoupling diode, in particular a rectifier diode, to the group input of the first lighting group.

In this embodiment, different signal paths are used during operation depending on the phase angle of the AC voltage source: if in a first sub-period, the first half-wave rectifier is forward-biased, then the applied supply voltage is fed to the second lighting group via the first lighting group and the first decoupling diode in the forward direction, so that the two lighting groups are again connected in series. In the next sub-period, the first half-wave rectifier is in the reverse direction, whereas the second half-wave rectifier is in the forward direction. In this sub-period, the supply voltage is fed via the second half-wave rectifier to the second lighting group and via the second decoupling diode in the forward direction to the first lighting group, so that the second and first lighting groups are arranged in series. Therefore, the switch-on and switch-off order for the lighting groups is changed according to the phase angle.

This embodiment has the advantage that the time-averaged on-times and off-times of the LEDs in each of the two lighting groups are identical.

In a development of this embodiment it is intended that two current-limiting arrangements are provided, which are preferably in the form of constant current sources and which are activated according to the phase angle of the AC power supply.

In a possible development of this embodiment it is provided that any number of lighting groups are provided in each series circuit rather than exactly two lighting groups. In this case, the lighting device comprises a chain containing at least two of the lighting groups, which are referred to below as chain elements. The first half-wave rectifier is connected, as before, to the group input (6) of a first lighting group as the first chain element of the chain, and the second half-wave rectifier is connected to the group input of a last lighting group as the last chain element of the chain. Any number of other chain elements can be arranged between the first chain element and the last chain element. The group output of the chain elements is in each case connected in series via a first decoupling diode to the group input of the next chain element. Thus the group output of the first chain element is connected to the group input of the second chain element, or to generalise, the group output of the $n^{th}$ chain element is connected to the group input of the $(n+1)^{th}$ chain element via a first decoupling diode. This connection forms a series circuit of lighting groups that can be successively activated in the first sub-period.

The group output of the chain elements is in each case connected in series via a second decoupling diode to the group input of the previous chain element. Thus the group output of the last lighting group is connected to the group input of the last-but-one lighting group via the second decoupling diode, or to generalise, the group output of the $n^{th}$ chain element is connected to the group input of the $(n-1)^{th}$ chain element via a second decoupling diode. This connection forms a series circuit of lighting groups that can be successively activated in the second sub-period.

In a possible development of the invention, the first lighting group and/or the last lighting group are divided into at least two sub-lighting groups, each of which comprises a bypass arrangement. By dividing the first lighting group and/or the last lighting group into sub-lighting groups, the lighting device can be adjusted to different peak values of the supply voltage. Thus when the supply voltage lies below the setpoint peak value, it is not the last lighting group of the series circuit that is not activated but, according to the situation, just the last sub-lighting group of the last lighting group. This filigree division supports energy-efficient operation of the lighting device.

In a possible structural embodiment of the invention, LEDs from different lighting groups are arranged in a common group, so that any differences in the lighting times of the different lighting groups are intermixed.

The described lighting device has many advantages:

First, it is a particularly simple and hence lightweight implementation of an LED lighting system, which is efficient in operation and economic to produce. It has been established in the implementation that no interference spikes occur during operation, and therefore RFI suppression can be dispensed with, for example.

The circuit advantageously behaves like a resistive load, which means that the current is always in phase with the voltage, further simplifying operation. A further advantage can be seen when there are voltage fluctuations, because when there is a lower maximum voltage of the AC power supply, only some of the lighting groups are not activated, which means that a lighting group remains even when the power supply is critical.

If there is a fault in a single LED in a lighting group, the entire lighting group is not immediately affected because the LEDS in the group concerned are bypassed via the bypass.

In possible developments, the current is shaped, in particular with regard to the phase and waveform, by the constant current source(s) according to the input voltage, in particular the mains voltage, of the AC power supply. In particular, current and input voltage are in-phase and have the same waveform. This means that the current and the input voltage are in-phase, and therefore the lighting device advantageously behaves like a resistive load. The input voltage or a derived control voltage is input to the constant current source(s) as a control signal for this purpose. By changing a stretch factor, the control signal can be compressed or expanded or, where dimming of the LEDs can be implemented by the stretch factor.

BRIEF DESCRIPTION OF THE DRAWINGS

Further features, advantages and effects of the invention arise from the following description of preferred exemplary embodiments of the invention and from the enclosed figures, in which.

DETAILED DESCRIPTION OF THE DRAWINGS

Figure 1:
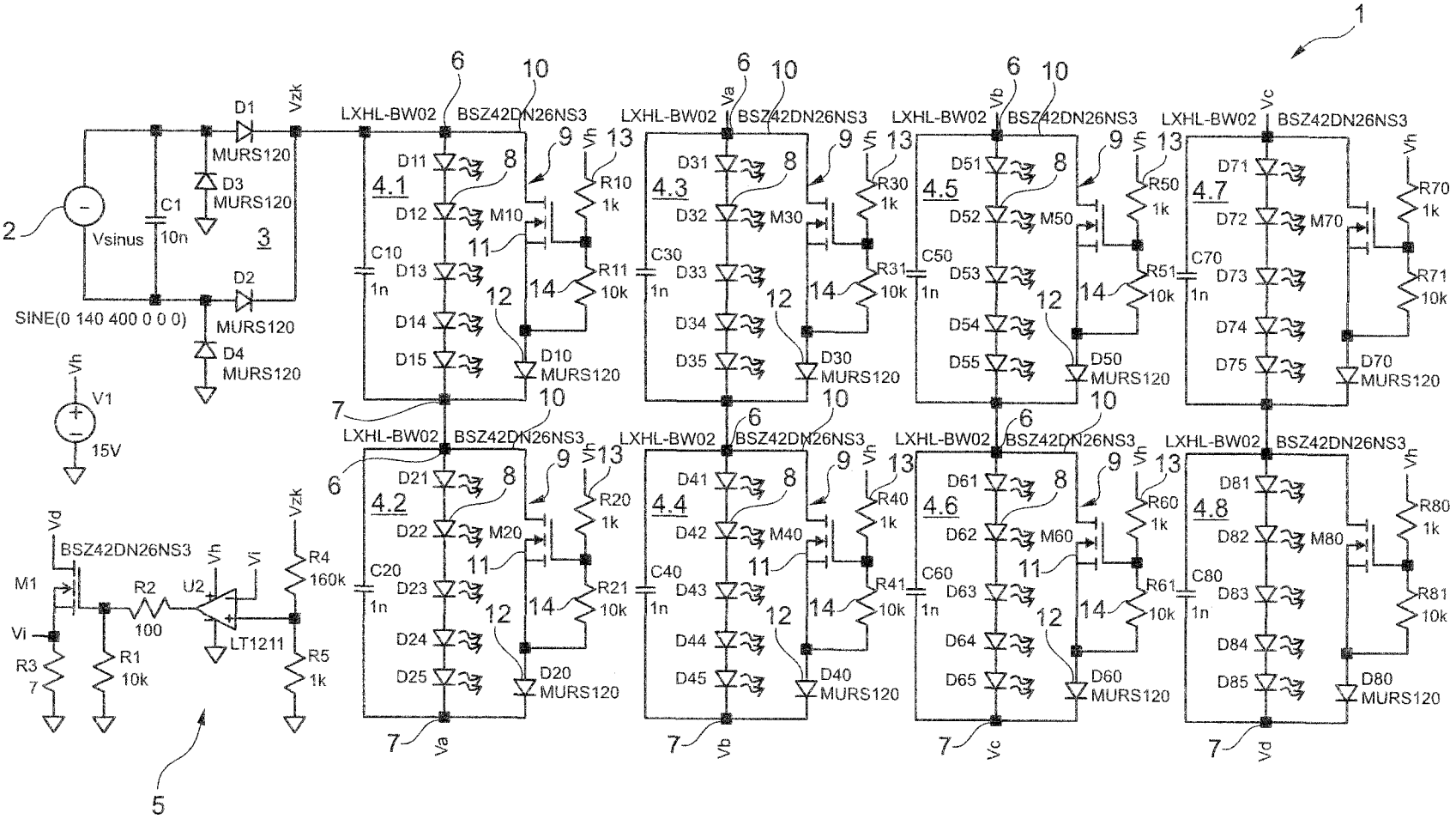
FIG. 1 shows a schematic circuit diagram of a lighting device as a first exemplary embodiment of the invention.

FIG. 1 shows in a schematic block diagram a lighting device 1 as a first exemplary embodiment of the invention. The diagram comes from the program LTspice IV from the Linear Technology Corporation, where the description of the graphical symbols—unless self-explanatory—can be found in the program specification, which is included by reference in the present disclosure. The other designations in the block diagram refer to components of the lighting device and can be taken to be examples of components used. The lighting device 1 can be used as a lighting system in buildings or in mobile units, in particular in an aircraft.

The lighting device 1 comprises an AC power supply 2, a rectifier arrangement 3, a plurality of lighting groups 4.1 to 4.8 and a constant current source 5. Starting from the AC power supply 2 via the rectifier arrangement 3, all the lighting groups 4 and the constant current source 5 are connected in series.

The AC power supply 2 provides a sinusoidal AC voltage, for example having an RMS value of 115 Volts. Other RMS values are also possible, such as e.g. 230 Volts. The frequency of the AC voltage equals 400 Hertz.

The rectifier arrangement 3 is connected after the AC power supply 2 and is in the form of a bridge rectifier and performs full-wave rectification. The sinusoidal AC voltage is converted into a pulsed DC voltage as a supply voltage Vzk in the form of a folded-up sinusoidal curve. Thus after the rectifier arrangement 3, two curves in the waveform of the supply voltage Vzk are provided in each period of the sinusoidal AC voltage of the AC power supply 2, each of said curves running from a zero voltage through a peak value back to the zero voltage. A triangular voltage can also be used, for example, instead of a sinusoidal AC voltage. Two bridge arms are provided in the rectifier arrangement 3, with a diode D1, D2 being arranged in the forward direction in each arm. An MURS120 is used, for example, as diodes D1, D2. In addition, each bridge arm is connected to ground via a diode D3 and D4 respectively of the same design but arranged in the reverse direction. Both bridge arms are also connected via a capacitor C1 having a capacitance of 10 nF.

Each of the lighting groups 4.1 to 4.8 has a group input 6 and a group output 7. The reference signs have been removed from the lighting groups 4.7 and 4.8 to make it easier to see the circuit. A plurality of light emitting diodes 8 (LEDs) are arranged in series between group input 6 and group 7. The light emitting diodes 8 in the first lighting group 4.1 are denoted by D1*x*, those in the second lighting group 4.2 by D2*x*. The light emitting diodes 8 are oriented in the forward direction from group input 6 to group output 7.

In addition, each lighting group 4.1 to 4.8 comprises a bypass arrangement 9, which comprises a switchable bypass 10, one end of which is connected to the group input 6, and the other end of which is connected to the group output 7. The bypass arrangement 9 comprises a MOSFET (metal oxide semiconductor field effect transistor, NMOS) 11, the drain of which is connected to the group input 6, and the source of which is connected via a further diode 12 to the group output 7. The diode 12 is likewise of type MURS120, for example, and is arranged in a signal path parallel to the light emitting diodes 8. An auxiliary voltage vh of +15 Volts is applied to the control electrode of the MOSFET 11 via a resistor 13 (R10 . . . R80=1 kOhms). The control electrode of the MOSFET 11 is connected to the source of the MOSFET 11 via a second resistor 14 (R11 . . . R81=10 kOhms).

The group output 7 of the first lighting group 4.1 is connected directly to the group input 6 of the second lighting group 4.2. The other lighting groups 4.3-4.8 are connected together in series in a similar manner. The lighting groups 4.1 . . . 4.8 each have the same design.

The last lighting group 4.8 of the lighting device 1 is connected by its group output 7 to an input vd of the constant current source 5, said constant current source 5 ensuring that there is sufficient constant current in the lighting device 1. For the purpose of controlling the constant current source 5, a control input of the constant current source 5 is connected to the supply voltage Vkz, which works as the control voltage.

The constant current thereby constantly tracks the supply voltage Vkz or the variation over time of the supply voltage Vkz.

The lighting device 1 operates in the following way: when no supply voltage Vzk is applied, the MOSFETs 11 are switched to the on-state, and therefore the bypass 10 is active in each of the lighting groups 4.1 to 4.8 and the light emitting diodes 8 are bypassed. As soon as the supply voltage Vzk starts to rise in accordance with its waveform, the voltage rises in the bypass 10 in the first lighting group 4.1. When the voltage present in the bypass 10 is greater than a cutoff voltage, said cutoff voltage being defined by means of the auxiliary voltage vh and the resistor 13 connected in series therewith, the MOSFET 11 is in the off-state, so that the bypass 10 is deactivated. The current is then directed via the light emitting diodes 8 in the first lighting group 4.1, so that they emit light.

If the supply voltage Vzk continues to rise, then applied to the second lighting group 4.2 is a voltage that equals the supply voltage Vzk minus the voltage drop across the LEDs 8 of the first lighting group 4.1. As the supply voltage Vzk rises further, the voltage applied to the group input 6 of the second lighting group also increases, with the bypass 10 still being active initially. If the voltage applied to the MOSFET 11 of the second lighting group 4.2 exceeds the cutoff value, which is defined in a similar manner as in the lighting group 4.1, then this bypass 10 is also deactivated, so that the current must flow via the LEDs 8 of the second lighting group 4.2. The further lighting groups 4.3-4.8 follow according to the same pattern, so that when the waveform of the supply voltage Vzk is rising, the lighting groups 4.1-4.8 are switched on successively. After the peak value of the curve of the supply voltage Vzk is passed, the lighting groups 4.1-4.8 are switched off, but in the reverse order 4.8-4.1, so that the last lighting group 4.8 is switched off first.

The fact that the supply voltage Vzk forms the control voltage for the constant current source 5 means that said constant current source always provides the appropriate current for the number of LEDs 8 emitting light.

Owing to the fact that the LEDs 8 of the lighting groups 4.1-4.8 are switched on gradually and switched off again in the reverse order 4.8-4.1, the time periods during which current flows in the lighting groups 4.1-4.8 are different, and therefore the brightness of the LEDs 8 in the different lighting groups 4.1-4.8 is also different.

Figure 2:
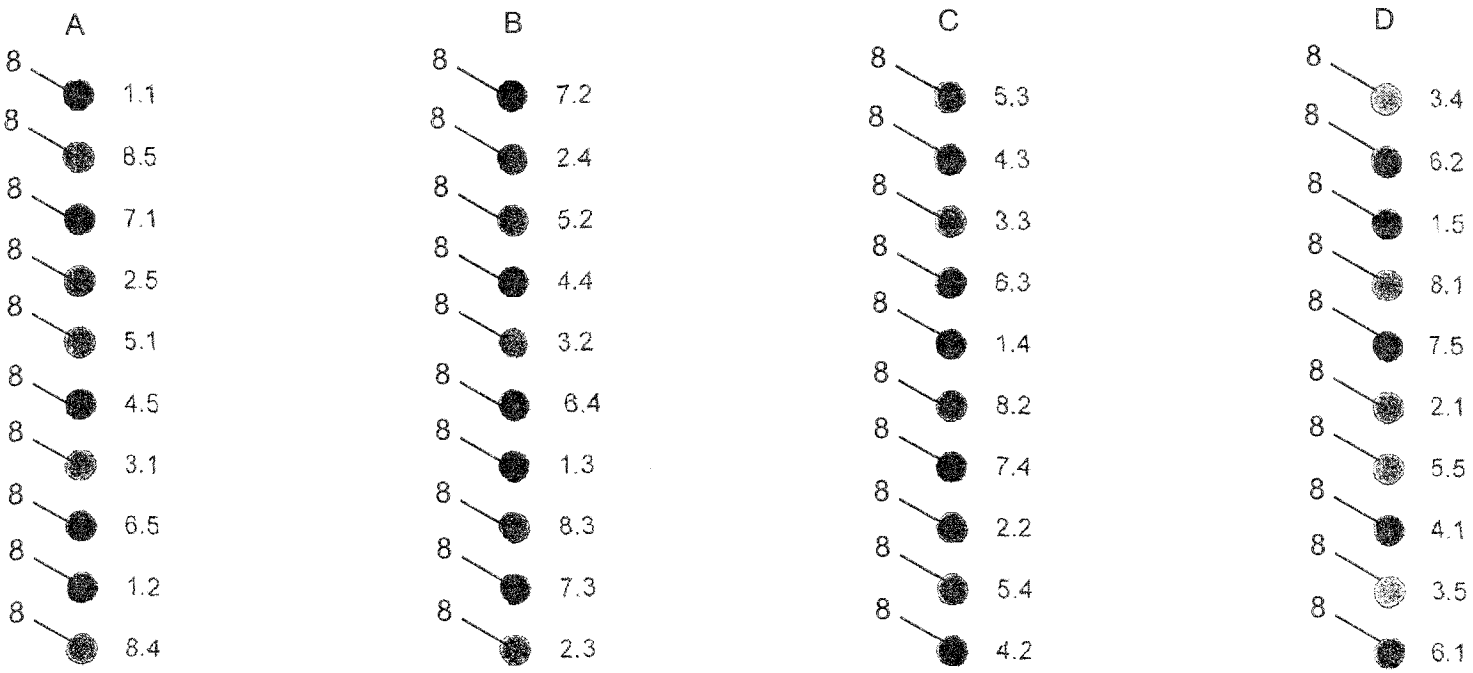
FIG. 2 shows a schematic diagram of the distribution of the LEDs of the lighting device in FIG. 1.

FIG. 2 shows a possible arrangement of the LEDs 8, in which the LEDs 8 of the different lighting groups 4.1-4.8 are mixed in the geometric arrangement, so that new groups A, B, C, D . . . are formed, with LEDs 8 from different lighting groups 4.1-4.8 being arranged in each group A, B, C, D . . . . The designations of the LEDs 8 relate to the diagram in FIG. 1. Thus the designation 1.1 refers to the LED 8 in the first lighting group 4.1 in the first position. Each of the groups A, B, C, D . . . have the same lighting characteristics because of the mixing.

Figure 3:
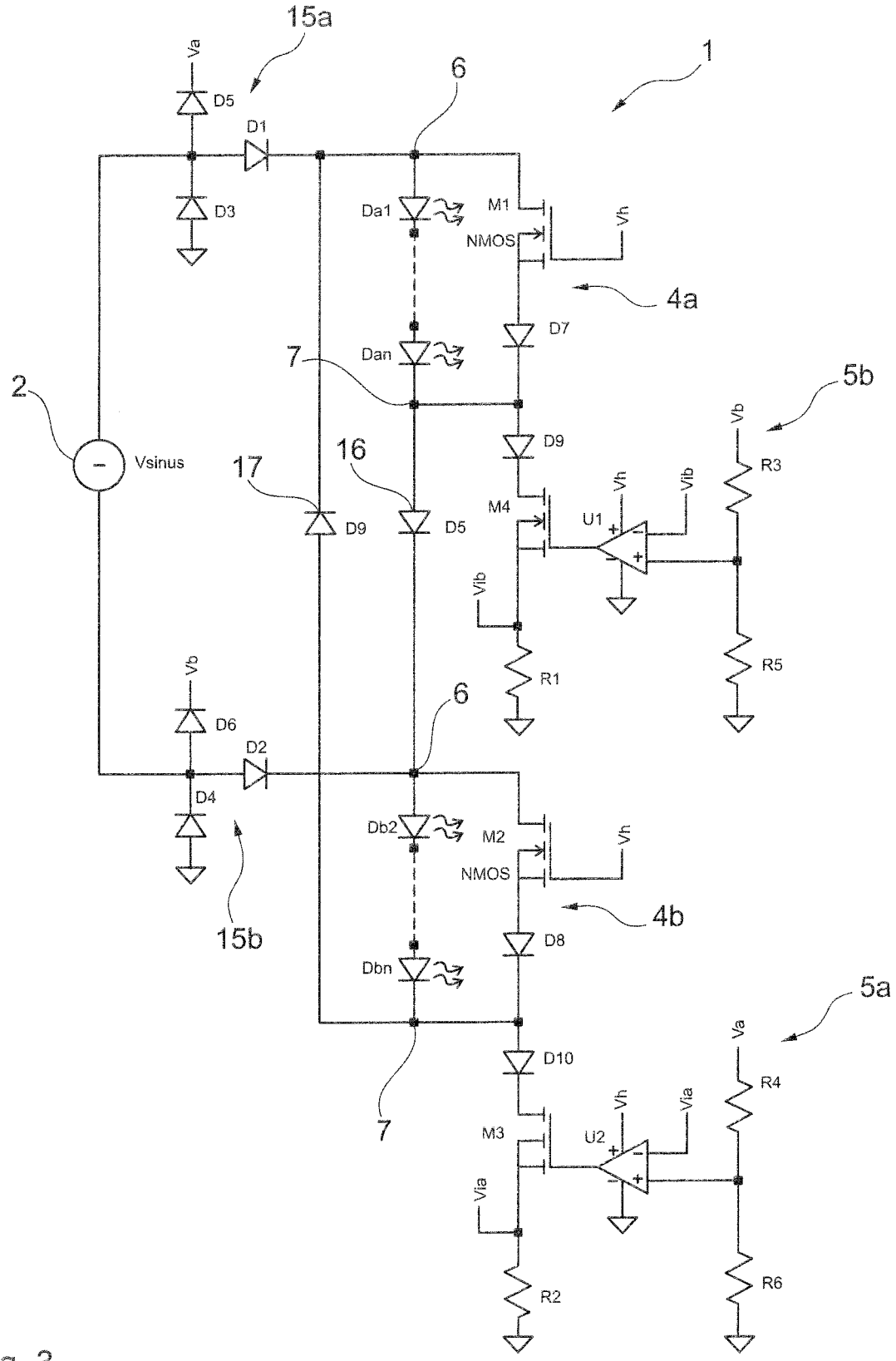
FIG. 3 shows a schematic circuit diagram of a second embodiment of the invention.

FIG. 3 shows a further schematic block diagram of a circuit of a lighting device 1 in the same representation as in FIG. 1 as a second embodiment of the invention.

The lighting device 1 again comprises the AC power supply 2, but which in this example is fed via two half-wave rectifiers 15*a*, 15*b*, each of which comprises a diode D1 and D2 respectively, which are oriented in the forward direction with respect to the AC power supply 2. In each half-wave rectifier 15*a*, 15*b* are provided branches via diodes D3 and D4 respectively, which are connected in the reverse direction however. A further branch in each half-wave rectifier 15*a*, 15*b* comprising a diode D5 and D6 respectively in the forward direction provides a supply voltage Va and Vb respectively.

After a half-wave rectification, a waveform having sinusoidal curves or half-waves exists at each output of the half-wave rectifiers 15*a*, 15*b*, said curves each occupying a half period of the sinusoidal voltage of the AC power supply 2 and alternating with each other. Thus in a first sub-period of the AC power supply 2, the supply voltage Vb equals 0, whereas the supply voltage Va has a waveform that follows a first curve. In a second sub-period of the AC power supply 2, the supply voltage Va equals 0 and the supply voltage Vb follows a curve.

Starting from the first half-wave rectifier 15*a*, initially the supply voltage Va is applied to the group input 6 of a first lighting group 4*a*, which has a similar design to the lighting groups 4.1-4.8 in FIG. 1, and therefore reference is made to the previous description. At the group output 7 of the first lighting group 4*a* is provided a connection to a second lighting group 4*b* and a connection to a second constant current source 5*b*. This second constant current source 5*b* receives as a control voltage the supply voltage Vb. The connection to the second lighting group 4*b* is made via a first decoupling diode 16, which is connected in the forward direction. A first constant current source 5*a*, which is controlled by means of the supply voltage Va, is arranged at the group output 7 of the second lighting group 4*b*.

Starting from the second half-wave rectifier 15*b*, initially the supply voltage Vb is applied to the group input 6 of the second lighting group 4*b*. At the group output 7 of the second lighting group 4*b* is provided a connection to the first lighting group 4*a* and a connection to the first constant current source 5*a*. The connection to the first lighting group 4*a* is made via a second decoupling diode 17, which is connected in the forward direction. The second constant current source 5*b* is arranged at the group output 7 of the first lighting group 4*a*.

The description of the operation distinguishes between the sub-periods of the AC power supply 2.

In the first sub-period of the AC power supply 2, the supply voltage Vb equals 0, whereas the supply voltage Va has a waveform that follows a first curve. With respect to the current flow, half-wave rectifier 15*a*, first lighting group 4*a*, second lighting group 4*b* and constant current source 5*a* are connected in series. When the supply voltage Va from the half-wave rectifier 15*a* is rising, the first lighting group 4*a* therefore switches on first and subsequently the second lighting group 4*b*. After the peak value, the lighting groups 4*a*, 4*b* are deactivated again in the reverse order.

In the second sub-period, the voltage of the half-wave rectifier 15*a* equals 0V, whereas the supply voltage Vb of the half-wave rectifier 15*b* follows a curve. The half-wave rectifier 15*b* is connected, with respect to the current flow, first to the second lighting group 4*b*, the group output 7 of which is connected via the second diode 17 to the group input 6 of the first lighting group 4*a*. The output of the first lighting group 4*a* is connected to the constant current source 5*b*, which is controlled by the supply voltage Vb and hence is active. In this second sub-period, when the supply voltage Vb is rising, the second lighting group 4*b* is therefore activated first and subsequently the first lighting group 4*a*. After the peak value is passed, the first lighting groups 4*a* is deactivated first and subsequently the lighting group 4*b*.

It is achieved by this form of circuit that during one half period the current flows first via the lighting group 4*a* and then via the lighting group 4*b*. During the other half period, the current flows in the reverse order, i.e. first via the lighting group 4*b* and then via the lighting group 4*a*. In this circuit, the time periods during which current flows in each of the lighting groups 4*a* and 4*b* are equal to each other, thereby improving the appearance and making the operating lives of the LEDs 8 approximately the same as each other.

It is particularly important to mention for the lighting devices 1 according to FIGS. 1 and 3 that they behave like a resistive load, i.e. that the current drawn from the AC power supply 2 behaves in-phase with the AC voltage of the AC power supply 2, as is required e.g. by the standards EN61000-3-2.

Figure 4:
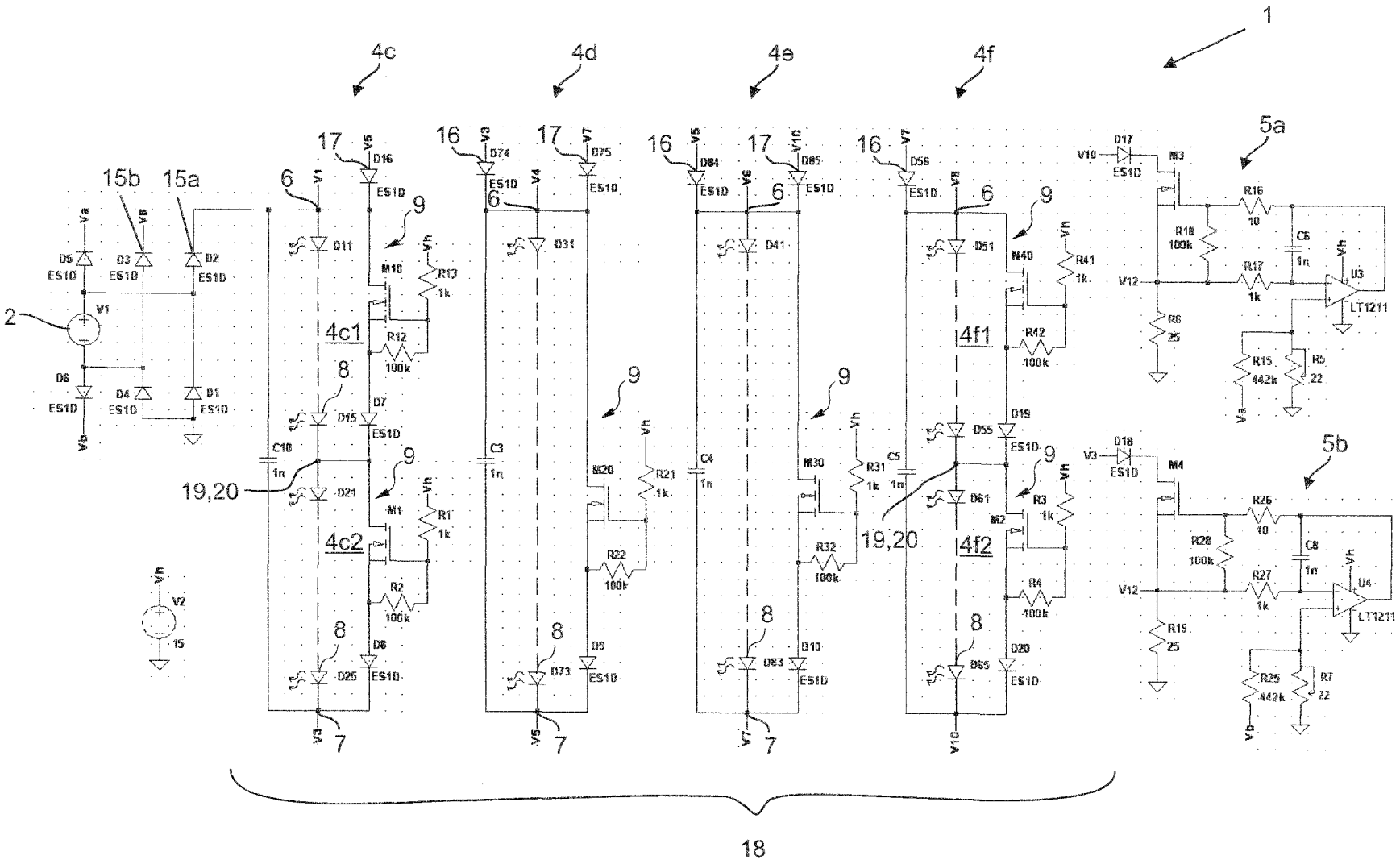
FIG. 4 shows a schematic circuit diagram of a third embodiment of the invention.

FIG. 4 shows a third exemplary embodiment of the invention in the same representation as FIGS. 1 and 3. Unlike the second exemplary embodiment in FIG. 3, the third exemplary embodiment comprises four lighting groups 4*c*, 4*d*, 4*e*, 4*f*, which together form a chain 18 and which, in this case like the lighting groups 4*a*, 4*b* in FIG. 3, are connected to one another. The lighting group 4*c* forms the first chain element of the chain 18, and the lighting group 4*f* the last chain element of the chain 18. The half-wave rectifier 15*a* is connected to the group input 6 (V1) of the lighting group 4*c*, and the half-wave rectifier 15*b* is connected to the group input 6 (V8) of the lighting group 4*f*. The lighting groups 4*c*, 4*d*, 4*e*, 4*f* are connected to one another by two ways: a first connection runs from the group output 7 of a previous chain element in the chain direction via a first decoupling diode 16 to the group input 6 of the next chain element, with a first constant current source 5*a* being connected to the group output 7 of the last chain element (4*f*); a second connection runs from the group output 7 of a chain element connected afterwards in the chain direction via a second decoupling diode 17 to the group input 6 of the previous chain element, with a second constant current source 5*b* being connected to the group output 7 of the first chain element (4*c*). The lighting device 1 in FIG. 4 works in a similar way to the lighting device 1 in FIG. 3, and therefore reference is made to the previous explanations.

The first and last lighting groups 4*c*, 4*f* each comprise two sub-lighting groups 4*c*1 and 4*c*2 and respectively 4*f*1 and 4*f*2. Each of the sub-lighting groups 4*c*1, 4*c*2, 4*f*1, 4*f*2 comprises a plurality of LEDs 8 and a bypass arrangement 9, and hence forms a lighting group. The sub-lighting groups 4*c*1-4*c*2 and 4*f*1-4*f*2 are connected in the assigned lighting groups 4*c* and 4*f* respectively only simply and without any interconnection of a decoupling diode, with in each case a subgroup output 19 being connected directly to a subgroup input 20. This optional embodiment has the advantage that in the event that the expected peak value of the supply voltage is not reached, an entire lighting group, i.e. the lighting group 4*f* for the first sub-period and the lighting group 4*c* for the second sub-period, does not fail, but just the sub-lighting group 4*c*2 and 4*f*2 respectively that is last in the series connection, so that as many LEDs 8 as possible are activated despite a reduced supply voltage.

LIST OF REFERENCES

1 lighting device
2 AC power supply
3 rectifier arrangement
4 lighting groups
5 constant current source
6 group input
7 group output
8 light emitting diode
9 bypass arrangement
10 switchable bypass
11 MOSFET
12 diode
13 first resistor
14 second resistor
15 rectifier
16 first decoupling diode
17 second decoupling diode
18 chain
19 subgroup output
20 subgroup input

What is claimed is:

1. A lighting device for an AC power supply comprising:

at least two lighting groups, wherein each lighting group comprises a group input, a group output and at least one LED, wherein the at least one LED is arranged between the group input and the group output, wherein the lighting groups are connected to one another in series, wherein each of the at least two lighting groups comprises a bypass arrangement, wherein said bypass arrangement comprises a switchable bypass, the switchable bypass being arranged in parallel with all the LEDs in each lighting group between the group input and the group output, and said bypass arrangement being configured to activate and bypass when an applied voltage is less than a cutoff voltage, and to deactivate the bypass when an applied voltage is greater than the cutoff voltage, at least one current-limiting arrangement connected in series with the at least two lighting groups and/or with the AC power supply, wherein the current-limiting arrangement comprises a constant current source, wherein the current flow is carried through the constant current source in-phase with the AC power supply.

2. The lighting device according to claim 1, wherein, in each lighting group, at least two LEDs are arranged in a series circuit.

3. The lighting device according to claim 1, wherein the bypass arrangement further comprises a MOSFET, wherein the bypass runs via the source and the drain of the MOSFET, and wherein an auxiliary voltage that defines the cutoff voltage is applied to the control electrode of the MOSFET.

4. The lighting device according to claim 3, wherein a diode is connected in the bypass arrangement between the source and the group output, the forward direction of said diode being parallel to the forward direction of the at least one LED in the lighting group.

5. The lighting device according to claim 1, wherein the AC power supply comprises a main voltage source.

6. The lighting device according to claim 1, further comprising a bridge rectifier for rectifying the AC voltage of the AC voltage source for generating a supply voltage, wherein the supply voltage for the lighting groups is a folded-over AC voltage.

7. The lighting device according to claim 1, further comprising:

a first half-wave rectifier and a second half-wave rectifier, the first half-wave rectifier and the second half-wave rectifier being arranged at the outputs of the AC power supply, and a chain comprising at least the two lighting groups for forming chain elements, wherein the first half-wave rectifier is connected to the group input of a first lighting group as the first chain element of the chain, and the second half-wave rectifier is connected to the group input of a last lighting group as the last chain element of the chain, wherein the group output of the chain elements is connected in series via first decoupling diodes to the group input of the next chain element, and the group output of the chain elements is connected in series via second decoupling diodes to the group input of the previous chain element.

8. The lighting device according to claim 7, wherein two current-limiting arrangements are provided.

9. The lighting device according to claim 7, wherein at least one of the first chain element and the last chain element comprises at least two sub-lighting groups, wherein each sub-lighting group is in the form of a lighting group, wherein the subgroup output of a sub-lighting group in front is connected to the subgroup input of a following sub-lighting group.

10. The lighting device according to claim 1, wherein the LEDs from different lighting groups are arranged in groups in an intermixed manner.

11. The lighting device according to claim 1, wherein the current flow through the constant current source has the same form as the input voltage of the AC power supply.

12. The lighting device according to claim 1, wherein the LEDs are dimmable by controlling the constant current source.

13. A lighting device for an AC power supply comprising:

at least two lighting groups, wherein each lighting group comprises a group input and a group output and at least one LED, wherein the at least one LED is arranged between the group input and the group output, wherein the lighting groups are connected to one another in series, wherein each of the at least two lighting groups comprises a bypass arrangement, wherein said bypass arrangement comprises a switchable bypass, the switchable bypass being arranged in parallel with all the LEDs in the lighting group between the group input and the group output, and said bypass arrangement being configured to activate a bypass when an applied voltage is less than a cutoff voltage, and to deactivate the bypass when an applied voltage is greater than the cutoff voltage, a first half-wave rectifier and a second half-wave rectifier, the first half-wave rectifier and the second half-wave rectifier being arranged at the outputs of the AC power supply, and a chain comprising at least the two lighting groups for forming chain elements, wherein the first half-wave rectifier is connected to the group input of a first lighting group as the first chain element of the chain, and the second half-wave rectifier is connected to the group input of a last lighting group as the last chain element of the chain, wherein the group output of the chain elements is connected in series via first decoupling diodes to the group input of the next chain element, and the group output of the chain elements is connected in series via second decoupling diodes to the group input of the previous chain element.

14. The lighting device according to claim 13, wherein, in the lighting group, at least two LEDs are arranged in a series circuit.

15. The lighting device according to claim 13, wherein the bypass arrangement further comprises a MOSFET, wherein the bypass runs via the source and the drain of the MOSFET, and wherein an auxiliary voltage that defines the cutoff voltage is applied to the control electrode of the MOSFET.

16. The lighting device according to claim 15, wherein a diode is connected in the bypass arrangement between the source and the group output, the forward direction of said diode being parallel to the forward direction of the at least one LED in the lighting group.

17. The lighting device according to claim 13, further comprising at least one current-limiting arrangement, which is connected in series with the at least two lighting groups and/or with the AC power supply.

18. The lighting device according to claim 17, wherein the current-limiting arrangement comprises a constant current source.

19. The lighting device according to claim 18, wherein the current flow is carried through the constant current source in-phase with the AC power supply.

20. The lighting device according to claim 19, wherein the current flow through the constant current source has the same form as the input voltage of the AC power supply.

21. The lighting device according to claim 19, wherein the LEDs are dimmable by controlling the constant current source.

22. The lighting device according to claim 13, wherein the AC power supply comprises a main voltage source.

23. The lighting device according to claim 13, further comprising a bridge rectifier for rectifying the AC voltage of the AC voltage source for generating a supply voltage, wherein the supply voltage for the lighting groups is a folded-over AC voltage.

24. The lighting device according to claim 13, wherein two current-limiting arrangements are provided.

25. The lighting device according to claim 13, wherein at least one of the first chain element and the last chain element comprises at least two sub-lighting groups, wherein each sub-lighting group is in the form of a lighting group, wherein the subgroup output of a sub-lighting group in front is connected to the subgroup input of a following sub-lighting group.

26. The lighting device according to claim 13, wherein the LEDs from different lighting groups are arranged in groups in an intermixed manner.

* * * * *